US006701859B2

(12) United States Patent
Matsuda et al.

(10) Patent No.: US 6,701,859 B2
(45) Date of Patent: Mar. 9, 2004

(54) PERSONAL WATERCRAFT

(75) Inventors: Yoshimoto Matsuda, Kobe (JP); Yoshinobu Tanaka, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/270,083

(22) Filed: Oct. 10, 2002

(65) Prior Publication Data

US 2003/0075089 A1 Apr. 24, 2003

(30) Foreign Application Priority Data

Oct. 18, 2001 (JP) ..... 2001-320291

(51) Int. Cl.[7] ..... B63B 35/73

(52) U.S. Cl. ..... 114/55.5; 440/83

(58) Field of Search ..... 440/83, 111; 114/55.5

(56) References Cited

U.S. PATENT DOCUMENTS 6,077,135 A * 6/2000 Ito ..... 440/83

* cited by examiner

*Primary Examiner*—Jesus D. Sotelo
(74) *Attorney, Agent, or Firm*—Kolisch Hartwell P.C.

(57) ABSTRACT

Disclosed is a personal watercraft comprising an engine capable of achieving a high power without increasing the diameter of an output shaft where a crankshaft-side sprocket is attached, and thus without increasing the diameter of the sprocket. The engine is configured such that an extended shaft that is separable from the crankshaft and has a diameter smaller than that of the crankshaft is connected to one end portion of the crankshaft so as to be coaxial with the crankshaft, and a sprocket is provided on the extended shaft. With such a structure, by forming the extended shaft of a material having relatively high strength, the diameter of the extended shaft can be made smaller than that of the crankshaft, and hence, the diameter of the sprocket provided on the extended shaft can be reduced. Since the diameter of a camshaft-side sprocket can be reduced, the size of the entire engine can be reduced.

11 Claims, 7 Drawing Sheets

PERSONAL WATERCRAFT

BACKGROUND OF THE INVENTION

1. Field of the Invention

The present invention relates to a jet-propulsion personal watercraft (PWC) which ejects water rearward and planes on a water surface as the resulting reaction. More particularly, the present invention relates to a personal watercraft which has an output shaft end portion of an engine with a unique structure.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In the jet-propulsion personal watercraft, a steering nozzle provided behind the outlet port of the water jet pump is swung either to the right or to the left, to change the ejection direction of the water to the right or to the left, thereby turning the watercraft to the right or to the left.

In the personal watercraft, a two-cycle engine has been conventionally employed as a propulsion engine. In addition to this, the use of a four-cycle engine has been contemplated.

In order to obtain a power as high as that of the two-cycle engine in the four-cycle engine without an increase in displacement, increasing an engine speed is effective. However, increasing the engine speed is unfavorable in view of the compatibility with a pump characteristic of the water jet pump.

Since the personal watercraft are utilized for various purposes as described above, there are demands for diverse engines including a normal power engine for family, a high-power engine for sport activities, etc. These engines are economically achieved by changing intake and exhaust efficiency or the like of one type of engine. In that case, the compatibility with the pump characteristic of the water jet pump needs to be considered because the engine speed increases as the power increases. In particular, in the case of the personal watercraft for sport activities which perform high-speed and active cruising, it is necessary to set its maximum engine speed high. Therefore, the compatibility with the pump characteristic needs to be carefully considered.

In order to obtain a higher power in the four-cycle engine, it is necessary to increase the diameter of a crankshaft for the purpose of ensuring sufficient physical strength of the crankshaft. With an increase in the diameter of the crankshaft, it becomes necessary to increase the diameter of a crankshaft-side sprocket provided on the crankshaft for driving a camshaft, and correspondingly increase the diameter of a camshaft-side sprocket provided on the camshaft (The rotation speed of the crankshaft is reduced by half and transmitted to the camshaft-side sprocket). This increases a volume in a cylinder head and a cylinder head cover for accommodating the camshaft-side sprocket, which results in a large-sized engine. Such a large engine is difficult to mount in the personal watercraft having an engine room limited in space.

As a solution to this, metal having high strength such as chromium-molybdenum steel could possibly be used for the crankshaft for the purpose of reducing the shaft diameter, which leads to increased cost.

SUMMARY OF THE INVENTION

The present invention addresses the above-described condition, and an object of the present invention is to provide a personal watercraft capable of obtaining a high power engine without the necessity of increasing a diameter of a crankshaft-side sprocket for driving a camshaft. Another object of the present invention is to provide a personal watercraft capable of transmitting power to a water jet pump at the rotation speed lower than the rotation speed of the crankshaft of the engine while maintaining the rotation speed of the crankshaft when obtaining the high power engine.

According to the present invention, there is provided a personal watercraft comprising: a water jet pump that ejects water rearward to propel the watercraft as a reaction of the ejecting water; an engine for driving the water jet pump; and an extended shaft placed coaxially with a crankshaft of the engine and having one end portion connected to one end portion of the crankshaft, wherein a mounting hole is formed at the one end portion of the crankshaft so as to be coaxial with the crankshaft, and the one end portion of the extended shaft constitutes an insertion portion inserted into the mounting hole.

In accordance with the invention, since the extended shaft independent of the crankshaft is connected to the one end portion of the crankshaft, only the diameter of the extended shaft can be reduced, or only the extended shaft can be made of the material having high strength. So, the engine mounted in the personal watercraft can be compactly configured. It should be appreciated that the extended shaft may be connected to an output-side end portion of the crankshaft (rear-side end portion of the watercraft), or to an end portion of the crankshaft located on the opposite side of the output-side end portion (front-side end portion of the watercraft).

Preferably, the extended shaft may be connected to the crankshaft so as to be integrally rotatable.

Preferably, the extended shaft may have a diameter smaller than a diameter of the one end portion of the crankshaft.

Preferably, the extended shaft having the small diameter may be provided with a sprocket for driving a camshaft of the engine.

In the above structure, since the crankshaft-side sprocket for driving the camshaft is provided on the extended shaft having the small diameter, the diameter of the crankshaft-side sprocket and hence the diameter of the corresponding camshaft-side sprocket can be reduced. Therefore, the cylinder head can be compactly configured. Even when it becomes necessary to increase the diameter of the crankshaft in order to obtain the high power in the engine, the size of the camshaft-side sprocket need not be increased, and consequently, the size of the entire engine is not increased. In this case, a diameter of a portion of the extended shaft, which is located on the opposite side of the crankshaft with respect to the crankshaft-side sprocket, is not necessarily small.

Preferably, the mounting hole of the crankshaft may be connected to the insertion portion of the extended shaft through a bearing such that the crankshaft and the extended shaft are rotatable relative to each other. With such a structure, for example, a reduction gear is capable of transmitting the power of the crankshaft to the extended shaft at the rotation speed lower than that of the crankshaft.

The personal watercraft constituted such that the crankshaft is connected to the extended shaft through the bearing as described above, may further comprise: a parallel shaft parallel to the crankshaft and the extended shaft; a first pair of gears having gears provided on the crankshaft and the parallel shaft, respectively, for causing the crankshaft and the parallel shaft to operate in association with each other; and a second pair of gears having gears provided on the extended shaft and the parallel shaft, respectively, for causing the extended shaft and the parallel shaft to operate in association with each other, and the first pair of gears and the second pair of gears are adapted to transmit a power of the crankshaft to the extended shaft.

With such a structure, the power for rotating the crankshaft can be transmitted to the extended shaft at the rotation speed lower than that of the crankshaft.

Preferably, in the structure in which the personal watercraft comprises the parallel shaft, the first pair of gears, and the second pair of gears, the extended shaft may be provided with a sprocket for driving a camshaft of the engine.

Preferably, the first pair of gears and the second pair of gears may be adapted to transmit the power of the crankshaft to the extended shaft at a rotation speed different from a rotation speed of the crankshaft.

Preferably, the personal watercraft further comprises: a gear casing separable from a crankcase of the engine and covering the first pair of gears and the second pair of gears. With such a structure, a gear unit comprised of the first pair of gears, the second pair of gears, and the like can be easily removably attached.

Preferably, an oil reservoir may be provided in an inner bottom portion of the gear casing. This makes it possible that the first pair of gears and the second pair of gears can be lubricated by simple splashing.

Preferably, at least a wall portion of the oil reservoir in a wall portion of the gear casing may be formed to have a double-walled structure, thereby forming a water jacket. With such a structure, the gear unit where the temperature is elevated during operation of the engine can be efficiently cooled.

The above and further objects and features of the invention will more fully be apparent from the foregoing detailed description with accompanying drawings.

DETAILED DESCRIPTION OF THE PREFERRED EMBODIMENTS

Hereinafter, a small boat according to an embodiment of the present invention will be described with reference to the accompanying drawings. Herein, a personal watercraft will be described.

(Embodiment 1)

Figure 1:
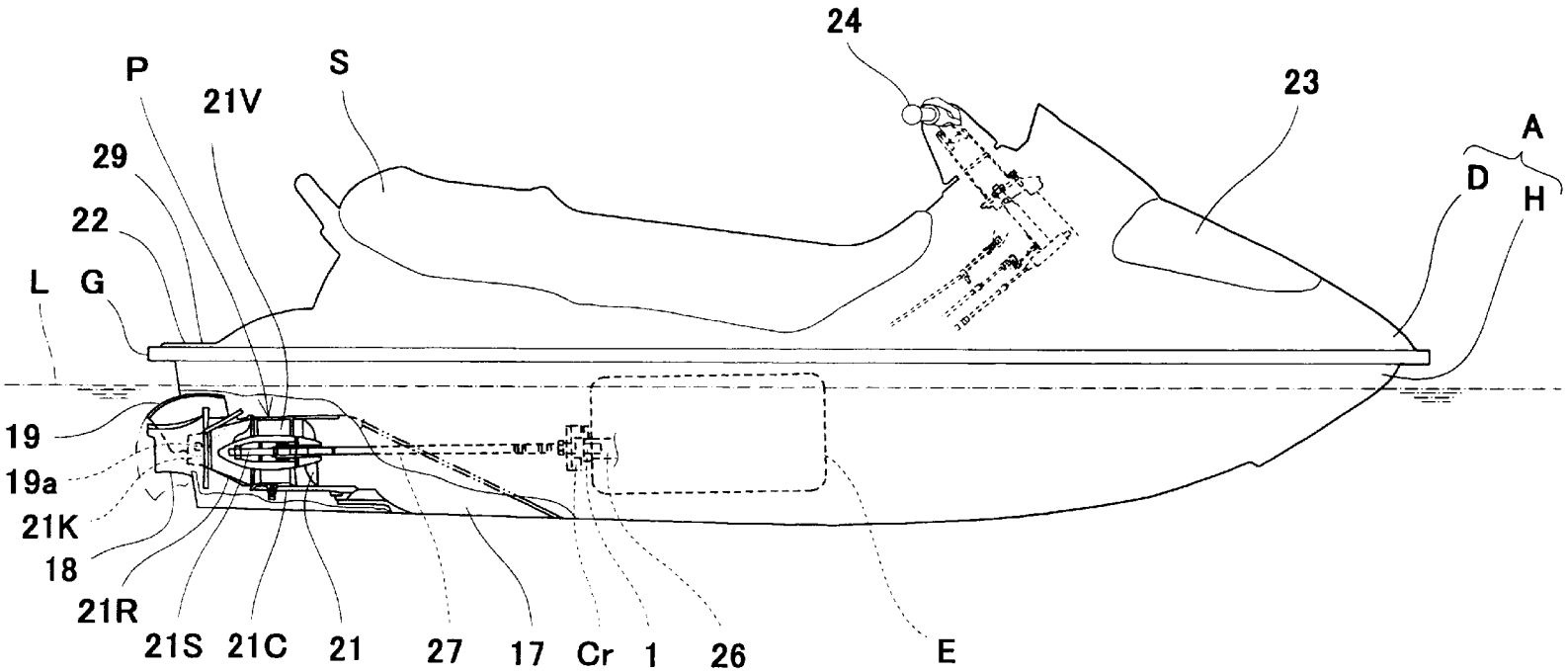
FIG. 1 is a side view of a personal watercraft according to an embodiment of the present invention.
Figure 2:
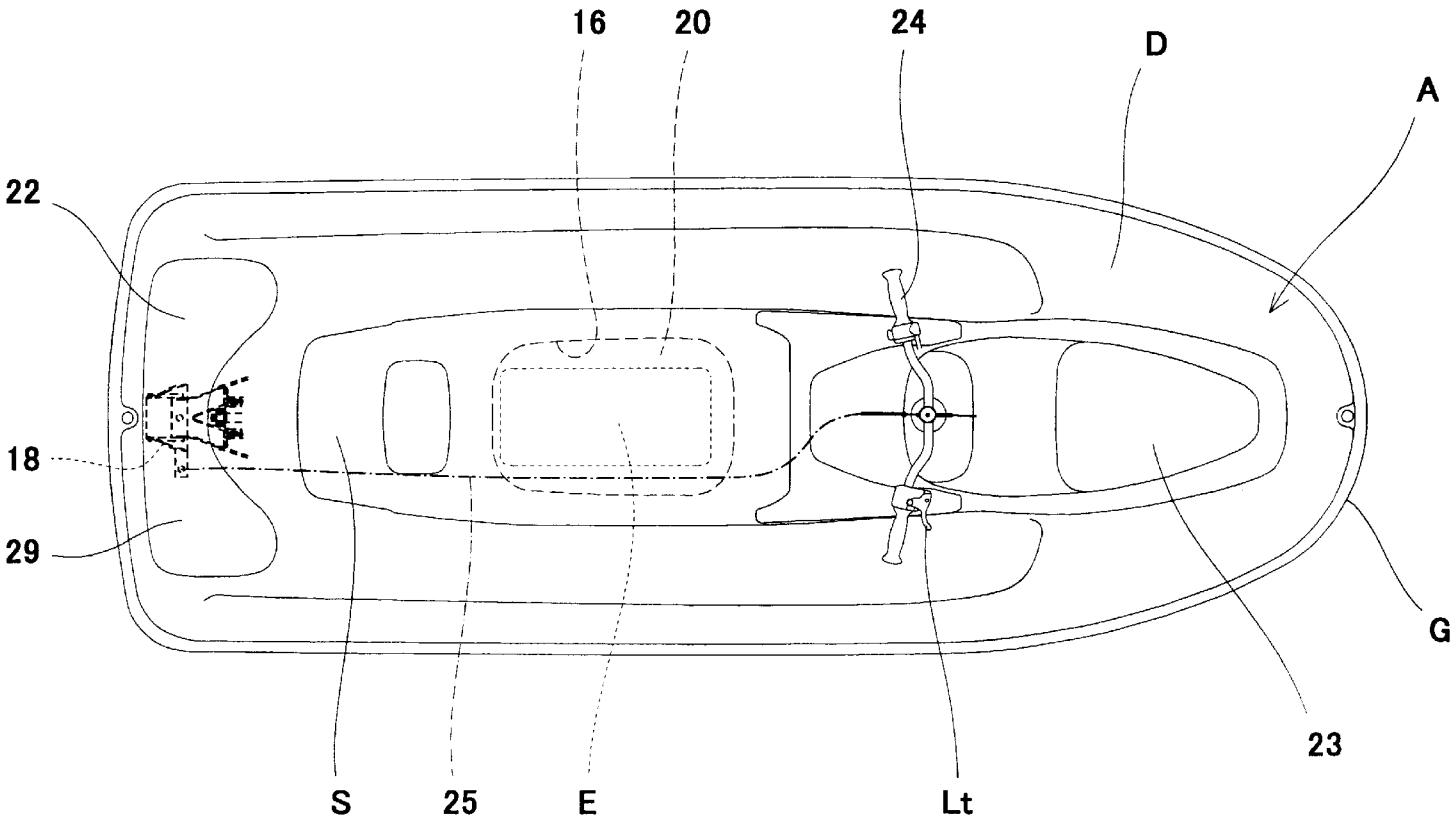
FIG. 2 is a plan view of the personal watercraft in FIG. 1.

FIG. 1 is a side view of a personal watercraft according to an embodiment of the present invention, and FIG. 2 is a plan view of the personal watercraft in FIG. 1. The personal watercraft in FIG. 1 has a seat on which a rider straddles. A body A of the watercraft comprises a hull H and a deck D covering the hull H from above. A line at which the hull H and the deck D are connected over the entire perimeter thereof is called a gunnel line G. The gunnel line G is located above a waterline L of the watercraft.

As shown in FIG. 2, an opening 16, which has a substantially rectangular shape as seen from above is formed at a substantially center section of the deck D in the upper portion of the body A such that its longitudinal direction corresponds with the longitudinal direction of the body A. A seat S is removably mounted over the opening 16.

An engine room 20 is provided in a space defined by the hull H and the deck D below the opening 16. An engine E for driving the personal watercraft is mounted in the engine room 20. The engine room 20 has a convex transverse cross-section such that its width is smaller in its upper portion than in its lower portion. In this embodiment, the engine E is an inline-type four-cylinder four-cycle engine. As shown in FIG. 1, the engine E is mounted such that a crankshaft 26 is placed along the longitudinal direction of the body A.

An output end of the crankshaft 26 is rotatably coupled integrally with a pump shaft 21S of a water jet pump P provided on the rear side of the body A through a propeller shaft 27. An impeller 21 is attached on the pump shaft 21S of the water jet pump P. Fairing vanes 21V are provided behind the impeller 21. The impeller 21 is covered with a pump casing 21C on the outer periphery thereof.

A water intake 17 is provided on the bottom of the body A. The water intake 17 is connected to the pump casing 21C through a water intake passage. The pump casing 21C is connected to a pump nozzle 21R provided on the rear side of the body A. The pump nozzle 21R has a cross-sectional area of gradually reduced rearward, and an outlet port 21K is provided on the rear end of the pump nozzle 21R.

The water is sucked from the water intake 17 and fed to the water jet pump P. The water jet pump P pressurizes and accelerates the water and the fairing vanes 21V fair water flow behind the impeller 21. The water is ejected through the pump nozzle 21R and from the outlet port 21K, and as a reaction of the ejecting water, the watercraft obtains a propulsion force.

In FIGS. 1, 2, reference numeral 24 denotes a bar-type steering handle. The steering handle 24 is connected to a steering nozzle 18 provided behind the pump nozzle 21R through a cable 25 (indicated by dashed line in FIG. 2). When the rider rotates the handle 24 to clockwise or counterclockwise, the steering nozzle 18 is swung toward the opposite direction so that the ejection direction of the water being ejected through the pump nozzle 21R can be changed and the watercraft can be correspondingly turned to any desired direction while the water jet pump P is generating the propulsion force.

As shown in FIG. 1, a bowl-shaped reverse deflector 19 is provided above the rear side of the steering nozzle 18 such that it can vertically swing around a horizontally mounted swinging shaft 19*a*. The deflector 19 is swung downward to a lower position around the swinging shaft 19*a* and located behind the steering nozzle 18 to deflect the ejected water from the steering nozzle 18 forward, and as the resulting reaction, the personal watercraft moves rearward.

In FIGS. 1, 2, a rear deck 22 is provided in the rear section of the body A. The rear deck 22 is provided with an openable rear hatch cover 29. A rear compartment (not shown) with a small capacity is provided under the rear hatch cover 29. In FIGS. 1, 2, a front hatch cover 23 is provided in a front section of the body A. A front compartment (not shown) is provided under the front hatch cover 23 for storing equipments and the like.

Figure 3:
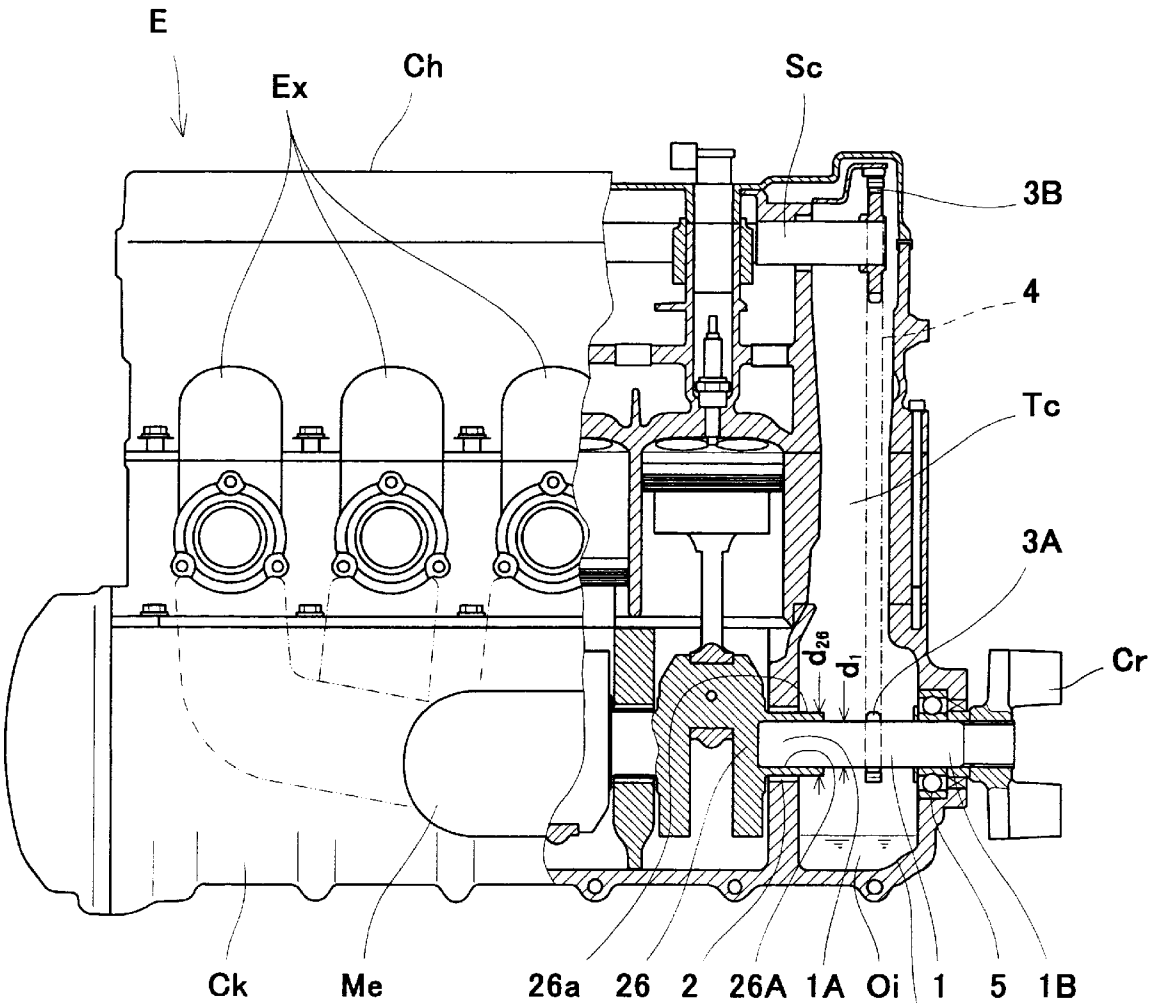
FIG. 3 is a partial cross-sectional side view of an engine, showing a structure of an output shaft portion of the engine mounted in the personal watercraft in FIG. 1.

Subsequently, a structure of the main part of the first embodiment of the present invention will be described. FIG. 3 is a partial cross-sectional side view of the engine, showing a structure of an output shaft portion of the engine E mounted in the personal watercraft in FIG. 1. As shown in FIG. 3, the engine E comprises a cylinder head Ch in an upper portion thereof and a crankcase Ck in a lower portion thereof, and in the crankcase Ck, the crankshaft 26 is rotatably mounted so as to penetrate the crankcase Ck.

A mounting hole 26A is formed at one end portion (rear end portion) of the crankshaft 26 such that the mounting hole 26A is coaxial with the crankshaft 26 and axially inwardly extends from a rear end face of the crankshaft 26. An insertion portion 1A (front end portion) of an extended shaft 1 having a relatively short length is inserted into the mounting hole 26A. The crankshaft 26 is coaxially connected to the extended shaft 1. The mounting hole 26A is spline-coupled to the insertion portion 1A to allow the crankshaft 26 and the extended shaft 1 to integrally rotate. The outer periphery of the rear end portion of the crankshaft 26 where the mounting hole 26A is provided is rotatably supported by means of a bearing 2 attached to the crankcase Ck. Therefore, the insertion portion 1A as the front end portion of the extended shaft 1 is rotatably supported by the crankcase Ck through the bearing 2.

A rear end portion 1B of the extended shaft 1 is rotatably supported through a bearing 5 at a penetrating hole formed in a wall portion of the crankcase Ck, which is located at a position rearward of the crankshaft in the direction in which the crankshaft extends, more specifically, in a rear side wall portion of a cam chain tunnel Tc provided at the rear portion of the engine E. To the rear end portion 1B of the extended shaft 1, coupling means Cr for connecting the propeller shaft 8 shown in FIG. 1 to the extended shaft 1 is connected.

In this embodiment, the crankshaft 26 is formed of general carbon steel and has a diameter d26, while the extended shaft 1 is formed of chromium-molybdenum steel having relatively high strength and has a diameter d1 smaller than the diameter d26 of the crankshaft 26. The material and the diameter d1 of the extended shaft 1 can be suitably selected according to maximum torque generated by the engine E so that the extended shaft 1 can rotate while maintaining proper rigidity and transmit a power to the propeller shaft 27.

A crankshaft-side sprocket 3A for driving a camshaft Sc is provided substantially at the center portion of the extended shaft 1 in the longitudinal direction so as to be coaxial with the extended shaft 1.

The cylinder head Ch provided in the upper portion of the engine E is provided with the camshaft Sc such that the longitudinal direction of the camshaft Sc corresponds with the longitudinal direction of the crankshaft 26. The rear end portion of the camshaft Sc extends to a position above the sprocket 3A provided at the extended shaft 1. A sprocket 3B on the camshaft Sc side having teeth twice as many as those of the sprocket 3A is provided at the rear end portion of the camshaft Sc, and the camshaft Sc and the sprocket 3B are adapted to integrally rotate. The sprockets 3A, 3B are connected by means of a chain 4. When the crankshaft 26 rotates, the camshaft Sc rotates at the rotation speed equal to ½ of the rotational speed of the crankshaft 26.

The sprockets 3A, 3B, and the chain 4 are accommodated in the cam chain tunnel Tc. An oil reservoir 30 is provided at the bottom of the cam chain tunnel Tc, and oil Oi reserved in the oil reservoir 30 is caused to splash by splash means (not shown), thereby lubricating the sprockets 3A, 3B, and the chain 4.

In the personal watercraft in which the engine E constituted as described above is mounted, the diameters of the sprockets 3A, 3B can be reduced. As a result, the cylinder head portion Ch of the engine E does not become large in size, and the high-power four-cycle engine can be mounted in the personal watercraft. Further, since it is not necessary to use an expensive material for the relatively long crankshaft 26, cost is controlled.

In FIG. 3, Ex denotes a plurality of exhaust pipes connected to the body of the engine E, and Me denotes an exhaust manifold for collecting exhaust gas flowing through the respective exhaust pipes Ex and introducing the collected exhaust gas to a muffler (not shown).

(Embodiment 2)

Figure 4:
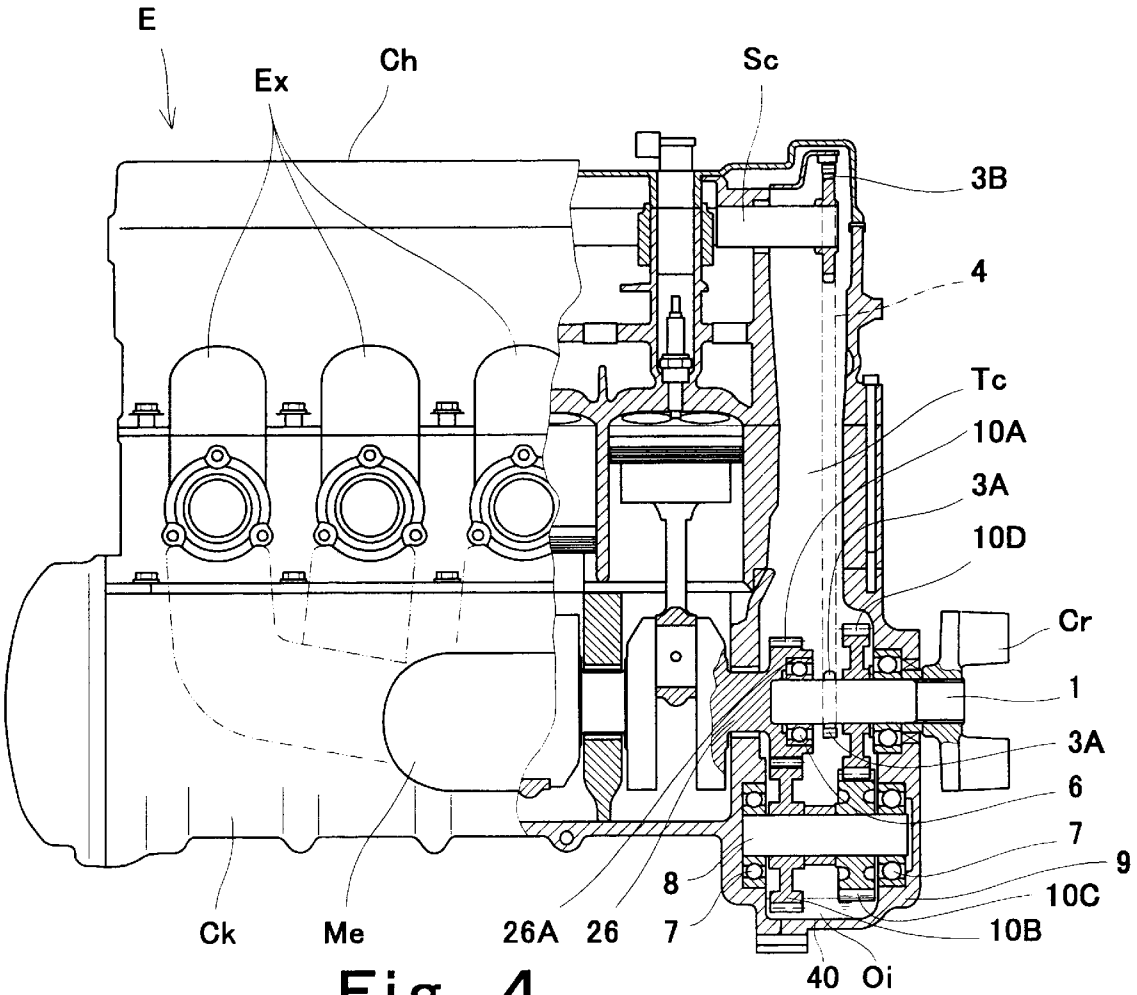
FIG. 4 is a partial cross-sectional side view of the engine, showing another structure of the output shaft portion of the engine.

A second embodiment of the present invention will be described with reference to FIG. 4. FIG. 4 is a partial cross-sectional side view of the engine E, showing another structure of the output shaft portion of the engine E mounted in the personal watercraft in FIG. 1. The engine E is capable of transmitting the power to the extended shaft 1 at the rotation speed lower than that of the crankshaft.

Hereinbelow, the difference between the engine E in FIG. 3 and the engine E in FIG. 4, will be described. The extended shaft 1 is rotatably inserted into the mounting hole 26A provided at the rear end portion of the crankshaft 26 through a bearing 6. The extended shaft 1 is coaxially connected to the crankshaft 26. A gear 10A is provided on the outside of the rear end portion of the crankshaft 26. The crankshaft 26 and the gear 10A are integrally rotatable.

A parallel shaft 8 is provided in parallel with the crankshaft 26 and the extended shaft 1 such that their longitudinal directions corresponds with one another. A front end portion of the parallel shaft 8 is rotatably supported through a bearing 7 by the crankcase Ck and the rear end portion of the parallel shaft 8 is rotatably supported through another bearing 7 by a gear casing 9 provided at a lower portion of the chain tunnel Tc.

A gear 10B which meshes with the gear 10A is provided in the vicinity of the front end portion of the parallel shaft 8 such that the gear 10B is rotatable integrally with the parallel shaft 8. The gears 10A, 10B form a pair (first pair) of gears. A gear 10C is provided in the vicinity of the rear end portion of the parallel shaft 8 so as to be rotatable integrally with the parallel shaft 8. A gear 10D which meshes with the gear 10C is rotatable integrally with the extended shaft 1. The gears 10C, 10D form a pair (second pair) of gears.

In the above constitution, the power from the crankshaft 26 is transmitted through the gear 10A to the gear 10B provided at the parallel shaft 8, then from the gear 10C provided at the parallel shaft 8 to the gear 10D provided at the extended shaft 1, and further through the coupling means Cr provided at the rear end portion of the extended shaft 1, to the propeller shaft 27 for driving the water jet pump P (see FIG. 1).

While the gears 10B, 10C are illustrated as being separable in FIG. 4, they may be integral with each other. In this case, the parallel shaft 8 may be a fixed shaft which is unrotatable with respect to the crankcase Ck and the gear casing 9, while the integral gears 10B, 10C may be rotatable with respect to the parallel shaft 8.

The sprocket 3A is provided between the gears 10A, 10D at the extended shaft 1 such that the sprocket 3A is coaxial and rotatable integrally with the extended shaft 1.

An oil reservoir 40 is provided at the bottom of the gear casing 9, for reserving oil Oi.

In the personal watercraft in which the engine E constituted as described above is mounted, in addition to the effects described in the first embodiment, the effects described below can be produced. By suitably setting the number of teeth of the gears 10A–10D, the power can be transmitted to the extended shaft 1 at the rotation speed lower than that of the crankshaft 26. Therefore, even when the power of the same engine is increased by, for example, changing its intake and exhaust system, that is, the maximum engine speed is increased to increase the engine power, the increased engine power can be easily adapted to the pump characteristic of the water jet pump P by forming a simply structured gear train at the rear end portion of the crankshaft 26 of the engine E.

Also, since the rotation speed of the extended shaft 1 becomes lower than the rotation speed of the crankshaft 26, the reduction gear ratio between the sprockets 3A, 3B can be reduced. As a result, the sprocket 3B on the camshaft Sc side can be size.

Further, since the splash means (not shown) causes the oil Oi reserved in the oil reservoir 40 to splash, the gears 10A–10D, the sprockets 3A, 3B, and the chain 4 can be lubricated.

In FIG. 4, the same reference numerals as those in FIG. 3 are used to identify the same or corresponding parts.

(Embodiment 3)

Figure 5:
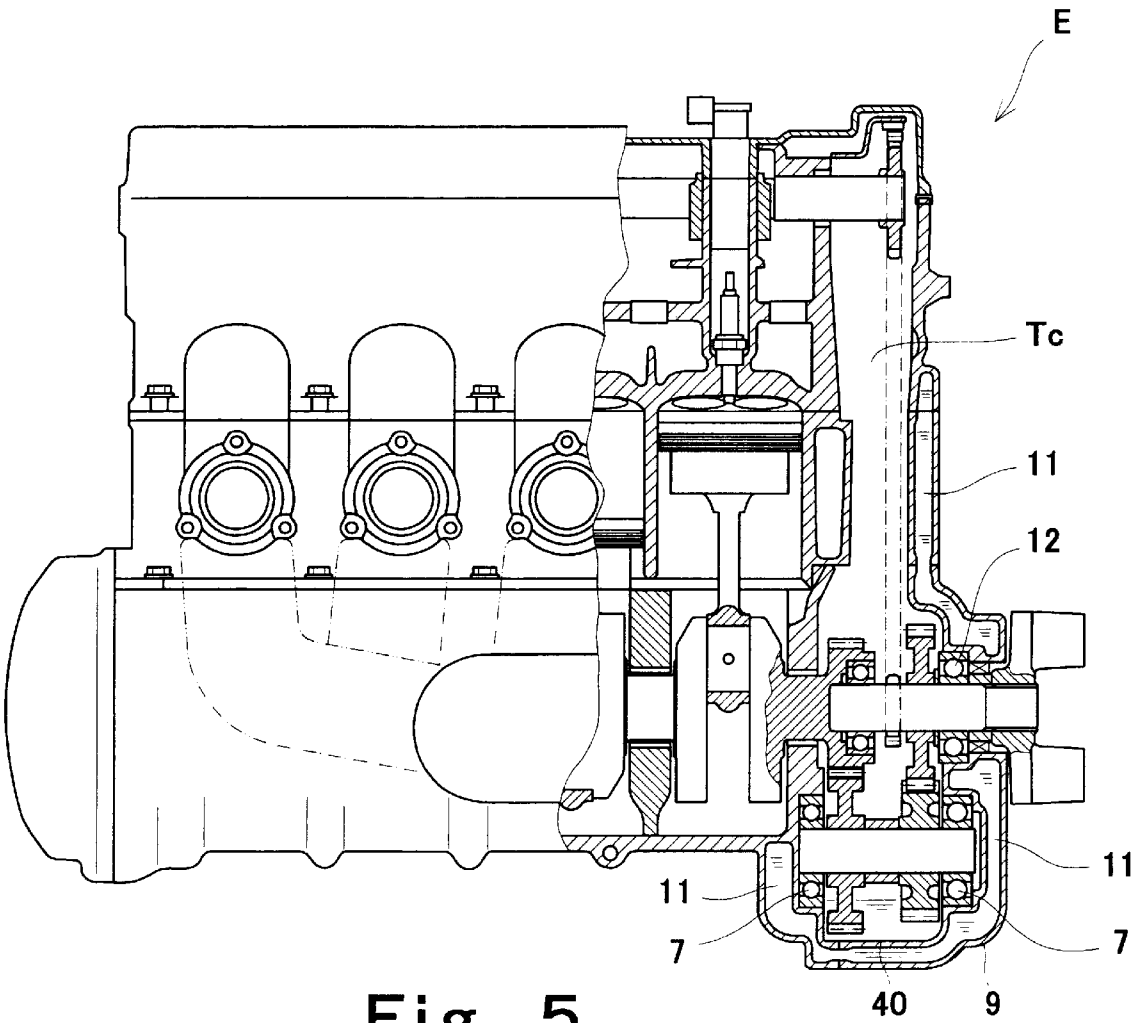
FIG. 5 is a partial cross-sectional side view of the engine, showing another structure of the output shaft portion of the engine.

A further embodiment of the present invention will be described with reference to FIG. 5. FIG. 5 is a partial cross-sectional side view of the engine, showing another structure of the output shaft portion of the engine mounted in the personal watercraft in FIG. 1. In the structure in FIG. 5, the gear casing 9 and part of the rear side wall portion of the chain tunnel Tc in FIG. 4 are formed to have a double-walled structure to allow cooling water to be supplied into a space 11 in the double-walled structure, thus forming a water jacket.

With such a structure, a gear unit having superior cooling capability is achieved. Besides, it is possible to produce a noise-proof effect by preventing occurrence of leakage of noises generated by the gears 10A–10D in mesh with one another while the engine E is operating.

The portion where the water jacket is formed is not intended to be limited to the portion in FIG. 5 but may be formed at other proper portion depending on the need for cooling. For example, the water jacket may be formed only at the bottom of the gear casing 9 corresponding to the oil reservoir 40. Alternatively, only the bottom portion of the gear casing 9 and the portion where the bearings 7, 12 are provided may be formed to have a double-walled structure, thus forming a water jacket.

(Embodiment 4)

Figure 6:
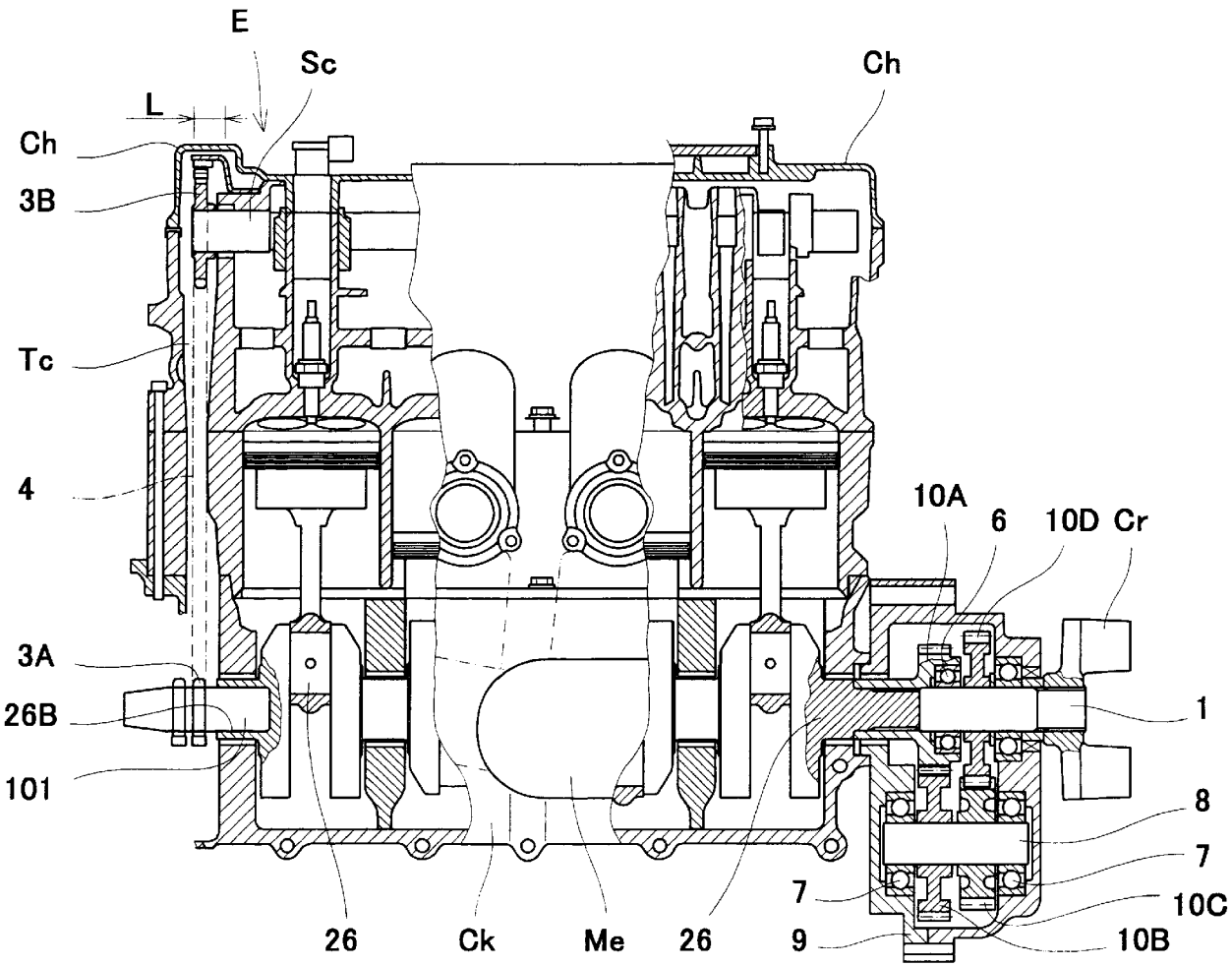
FIG. 6 is a partial cross-sectional side view of the engine, showing another structure of the output shaft portion of the engine.

A still further embodiment of the present invention will be described with reference to FIG. 6. FIG. 6 is a partial cross-sectional side view of the engine, showing another structure of the output shaft portion of the engine mounted in the personal watercraft in FIG. 1. In the engine E in FIG. 6, in addition to the extended shaft 1 connected to the rear end portion of the crankshaft 26 in the engine E in FIG. 4, an extended shaft 101 is connected to the front side of the crankshaft 26 and provided with the sprocket 3A.

A more detail of the difference between the engine E in FIG. 4 and the engine E in FIG. 6 will be described. A mounting hole 26B is provided at the front end portion of the crankshaft 26 and the extended shaft 101 is mounted to the mounting hole 26B. Thereby, the crankshaft 26 is connected to the extended shaft 101 such that they are coaxial and rotatable integrally with each other. The sprocket 3A on the crankshaft 26 side for driving the camshaft Sc is provided on the extended shaft 101 such that the sprocket 3A is coaxial and rotatable integrally with the extended shaft 101. Another extended shaft 1 is provided and a reduction gear having a mechanism similar to the second embodiment is provided at the rear end portion of the crankshaft 26.

A front end portion of the camshaft Sc provided in the cylinder head Ch extends to the position above the sprocket 3A provided on the extended shaft 101. The sprocket 3B is provided at the front end portion of the camshaft Sc so as to be rotatable integrally with the camshaft Sc.

The extended shaft 101 is formed of a material having relatively high strength such as chromium-molybdenum steel and has a diameter smaller than that of a crank journal of the crankshaft 26, that is, the portion provided with the mounting hole 26B.

With such a structure, the dimension of the engine E in the front and rear direction can be advantageously reduced.

In FIG. 6, the same reference numerals as those in FIG. 4 are used to identify the same or corresponding parts.

Figure 7:
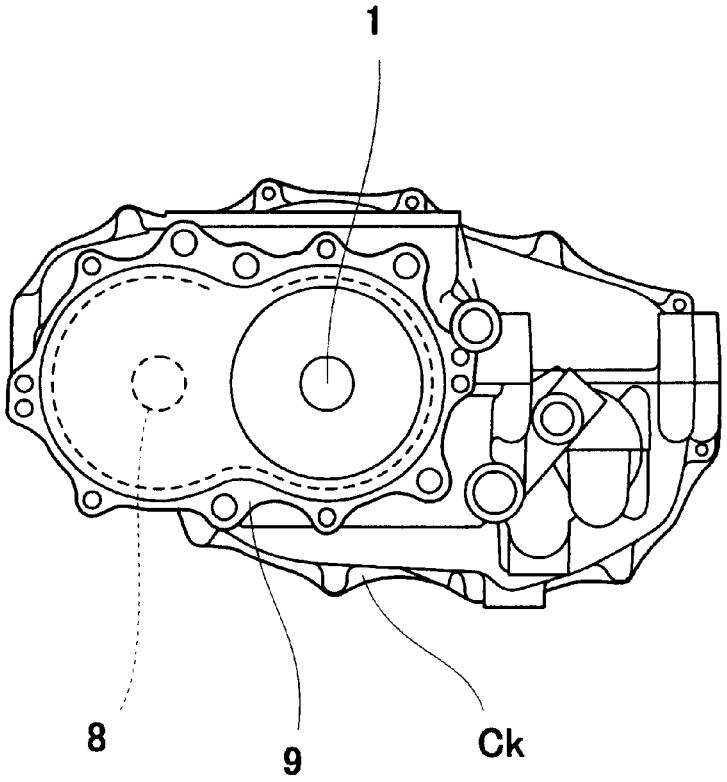
FIG. 7 is a view showing an arrangement of a parallel shaft and a shape of a gear casing shown in FIGS. 4–6, as seen from the rear side of the engine.

For easier understanding of the structure, in the engine E shown in FIGS. 4–6, the parallel shaft 8 is located below the extended shaft 1, although the parallel shaft 8 may be actually placed laterally of the extended shaft 1 in order to reduce the height of the engine E. FIG. 7 is a view showing placement of the parallel shaft 8 and a shape of the gear casing 9 in FIGS. 4–6, as seen from the rear side of the engine. As shown in FIG. 7, the parallel shaft 8 is placed on the left side of the extended shaft 1.

In the above-mentioned structures, while the rotation of the crankshaft 26 is transmitted to the camshaft Sc by using the sprockets 3A, 3B and the chain 4, the sprockets and the chain may be replaced by pulleys and a belt.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a water jet pump that ejects water rearward to propel the watercraft as a reaction of the ejecting water;

an engine for driving the water jet pump, the engine having a crankcase and a crankshaft rotatably mounted therein; and an extended shaft placed coaxially with the crankshaft of the engine and having a first end portion connected to one end portion of the crankshaft, the extended shaft further having a second end portion supported by the crankcase and being rotatable;

wherein a mounting hole is formed at the one end portion of the crankshaft so as to be coaxial with the crankshaft, and the first end portion of the extended shaft constitutes an insertion portion inserted into the mounting hole; and wherein the extended shaft is connected to the crankshaft so as to be integrally rotatable.

2. The personal watercraft according to claim 1, wherein the second end portion of the extended shaft is rotatably mounted to a wall portion of a cam chain tunnel via a bearing, the wall portion being supported by the crankcase.

3. The personal watercraft according to claim 1, wherein the extended shaft has a diameter smaller than a diameter of the one end portion of the crankshaft.

4. A personal watercraft comprising:

a water jet pump that ejects water rearward to propel the watercraft as a reaction of the ejecting water;

an engine for driving the water jet pump; and an extended shaft placed coaxially with a crankshaft of the engine and having one end portion connected to one end portion of the crankshaft;

wherein a mounting hole is formed at the one end portion of the crankshaft so as to be coaxial with the crankshaft, and the one end portion of the extended shaft constitutes an insertion portion inserted into the mounting hole; and wherein the extended shaft is provided with a sprocket for driving a camshaft of the engine.

5. A personal watercraft comprising:

a water jet pump that ejects water rearward to propel the watercraft as a reaction of the ejecting water;

an engine for driving the water jet pump; and an extended shaft placed coaxially with a crankshaft of the engine and having one end portion connected to one end portion of the crankshaft;

wherein a mounting hole is formed at the one end portion of the crankshaft so as to be coaxial with the crankshaft, and the one end portion of the extended shaft constitutes an insertion portion inserted into the mounting hole; and wherein the mounting hole of the crankshaft is connected to the insertion portion of the extended shaft through a bearing such that the crankshaft and the extended shaft are rotatable relatively to each other.

6. The personal watercraft according to claim 5, further comprising:

a parallel shaft parallel to the crankshaft and the extended shaft;

a first pair of gears having gears provided on the crankshaft and the parallel shaft, respectively, for causing the crankshaft and the parallel shaft to operate in association with each other; and a second pair of gears having gears provided on the extended shaft and the parallel shaft, respectively, for causing the extended shaft and the parallel shaft to operate in association with each other, wherein the first pair of gears and the second pair of gears are adapted to transmit a power of the crankshaft to the extended shaft.

7. The personal watercraft according to claim 6, wherein the extended shaft is provided with a sprocket for driving a camshaft of the engine.

8. The personal watercraft according to claim 6, wherein the first pair of gears and the second pair of gears are adapted to transmit the power of the crankshaft to the extended shaft at a rotation speed different from a rotation speed of the crankshaft.

9. The personal watercraft according to claim 6, further comprising:

a gear casing separable from a crankcase of the engine and covering the first pair of gears and the second pair of gears.

10. The personal watercraft according to claim 9, wherein an oil reservoir is provided in an inner bottom portion of the gear casing.

11. The personal watercraft according to claim 10, wherein at least a wall portion of the oil reservoir in a wall portion of the gear casing is formed to have a double-walled structure, thereby forming a water jacket.

* * * * *